US011478908B2

(12) United States Patent
Teng et al.

(10) Patent No.: US 11,478,908 B2
(45) Date of Patent: Oct. 25, 2022

(54) IMPACT WRENCH

(71) Applicant: MOBILETRON ELECTRONICS CO., LTD., Taichung (TW)

(72) Inventors: Cheng-I Teng, Taichung (TW); Ying-Tang Wang, Taichung (TW)

(73) Assignee: MOBILETRON ELECTRONICS CO., LTD., Taichung (TW)

( * ) Notice: Subject to any disclaimer, the term of this patent is extended or adjusted under 35 U.S.C. 154(b) by 182 days.

(21) Appl. No.: 16/933,536

(22) Filed: Jul. 20, 2020

(65) Prior Publication Data

US 2021/0046620 A1 Feb. 18, 2021

(30) Foreign Application Priority Data

Aug. 14, 2019 (TW) ..... 108128963

(51) Int. Cl.
*B25B 21/02* (2006.01)
*B25B 23/00* (2006.01)

(52) U.S. Cl.
CPC ..... *B25B 21/02* (2013.01); *B25B 23/00* (2013.01)

(58) Field of Classification Search
CPC ..... B25B 21/02; B25B 23/00
USPC ..... 173/90
See application file for complete search history.

(56) References Cited

U.S. PATENT DOCUMENTS 4,974,475 A * 12/1990 Lord ..... B25B 21/004 81/57.13
6,082,468 A 7/2000 Pusateri et al.
9,550,284 B2 1/2017 Seith et al.
9,592,600 B2 * 3/2017 Seith ..... B25F 5/02
2006/0043818 A1 3/2006 Chen
2014/0216775 A1 8/2014 Seith et al.

FOREIGN PATENT DOCUMENTS

CN 101659051 A 3/2010
CN 104972435 A 10/2015
CN 108687708 A 10/2018
TW 577789 B 3/2004
TW M265180 U 5/2005
TW M406497 U 7/2011
TW I626125 B 6/2018

(Continued)

OTHER PUBLICATIONS

Examination report for TW108128963, dated Jan. 14, 2020, Total of 4 pages.

(Continued)

*Primary Examiner* — Michelle Lopez

(74) *Attorney, Agent, or Firm* — Apex Juris, PLLC; Hilde Coeckx

(57) ABSTRACT

An impact wrench includes a front housing and a motor. A transmission mechanism and an impact mechanism are disposed in the front housing. A transmission direction of a force outputted by the motor is changed via the transmission mechanism to drive a working member of the impact mechanism to rotate. A part of the working member is protruded and is exposed outside the front housing. The front housing includes a seat and a covering member which are detachably engaged. The detachable engagement between the seat and the covering member is convenient for a user to maintain an inside of the impact wrench.

12 Claims, 9 Drawing Sheets

(56) References Cited

FOREIGN PATENT DOCUMENTS

| | | | |
|---|---|---|---|
| TW | I657898 | B | 5/2019 |
| TW | M579083 | U | 6/2019 |
| WO | 2017110229 | A1 | 6/2017 |

OTHER PUBLICATIONS

Search report for TW108128963, dated Jan. 14, 2020, Total of 1 page.
English abstract for TW577789, Total of 1 page.
English abstract for TWI626125, Total of 1 page.
English abstract for TWI657898, Total of 1 page.
English abstract for TWM406497, Total of 1 page.
English abstract for TWM579083, Total of 1 page.
English abstract for WO2017110229, Total of 1 page.
Search report for CN201910762730.8, dated Dec. 2, 2021, Total of 2 pages.
Abstract of US2006043818 (A1) corresponding document for TWM265180 (U), Total of 1 page.
English abstract for CN108687708, Total of 1 page.
English abstract for CN104972435, Total of 1 page.
English abstract for CN101659051, Total of 1 page.

* cited by examiner

IMPACT WRENCH

BACKGROUND OF THE INVENTION

Technical Field

The present invention relates generally to an impact wrench, and more particularly to an impact wrench having a detachable housing which facilitates maintenance.

Description of Related Art

In modern industrial applications, except using a general screwdriver or a wrench to tighten or loosen a fastener (e.g. screws, nuts, and so on), most of modern users will choose to use an impact tool (or a power tool) in order to improve an efficiency. The impact tool can provide great torque force and great impact force to tighten or loosen the fastener effectively and quickly.

Additionally, another impact tool is developed in order to solve a problem that an impact tool can't be adapted to a narrow space, wherein the another impact tool usually includes a motor, a transmission device, and an impact device. An output shaft of the motor is connected to the transmission device, and a working member (e.g. an anvil) of the impact device will transfer torque provided by the motor into a powerful rotational impact through the transmission device. The transmission device generally includes a plurality of transmission gears (e.g. bevel gear assembly). An output of the output shaft of the motor is transmitted by the transmission device, so that an axis of the working member of the impact device is perpendicular to an axis of the output shaft of the motor, thereby to solve the problem that the impact tool cannot be used in a narrow space.

After the impact tool is used for a long time, dust is easily accumulated in the impact tool, which may cause the gears or the bearings are worn more seriously. In order to ensure a precision of rotation, the impact tool needs to be maintained (e.g. interior clean, lubrication, and so on) after using a certain period of time. However, the conventional impact tool is hard to be disassembled or assembled, so that it's inconvenient to carry out an interior maintenance.

BRIEF SUMMARY OF THE INVENTION

In view of the above, the primary objective of the present invention is to provide an impact wrench having a detachable housing, which facilitates disassembly and assembly to carry out an interior maintenance.

The present invention provides an impact wrench includes a front housing and a motor. A transmission mechanism and an impact mechanism are disposed in the front housing. A direction of a force outputted by the motor is changed through the transmission mechanism to drive a working member of the impact mechanism to rotate. A part of the working member is protruded and is exposed outside the front housing. The front housing includes a seat and a covering member which is detachably engaged with the seat, wherein the seat has a first joining surface and a first abutting surface which are adjoined. The first joining surface and the first abutting surface are located on different horizontal planes but not perpendicular to each other. The covering member has a second joining surface and a second abutting surface. The second joining surface is closely abutted to the first joining surface, and the second abutting surface is closely abutted to the first abutting surface when the seat is engaged with the covering member. The covering member has a perforation, and a part of the working member passes through the perforation.

The present invention provides another impact wrench includes a front housing and a motor. A transmission mechanism and an impact mechanism are disposed in the front housing. A direction of a force outputted by the motor is changed through the transmission mechanism to drive a working member of the impact mechanism to rotate. A part of the working member is protruded and is exposed outside the front housing. The front housing includes a seat, a first cap and a second cap, wherein a receiving space is formed together by the seat, the first cap, and the second cap. The first cap has a perforation, and a part of the working member passes through the perforation. When the second cap is removed, an opening of the front housing, which communicates with the receiving space, is exposed.

The impact wrench provided by the present invention includes the seat and the covering member which are detachably engaged to each other, thereby to make the interior maintenance of the impact wrench be carried out easily; likewise, the another impact wrench provided by the present invention includes the first cap and the second cap which are detachably engaged with the seat, which could facilitate interior maintenance of the impact wrench as well.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
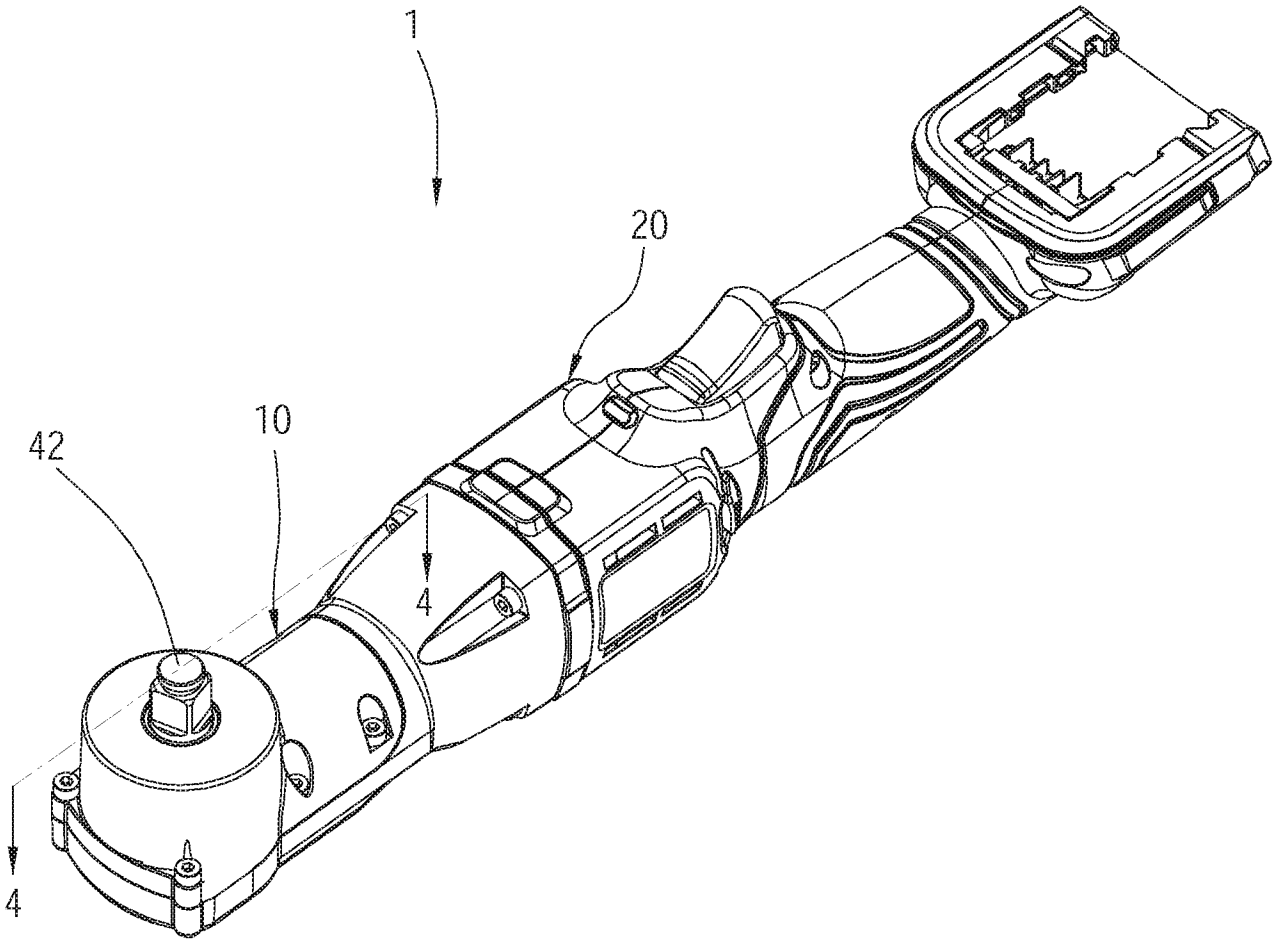
FIG. 1 is a perspective view of the impact wrench of a first embodiment according to the present invention.
Figure 2:
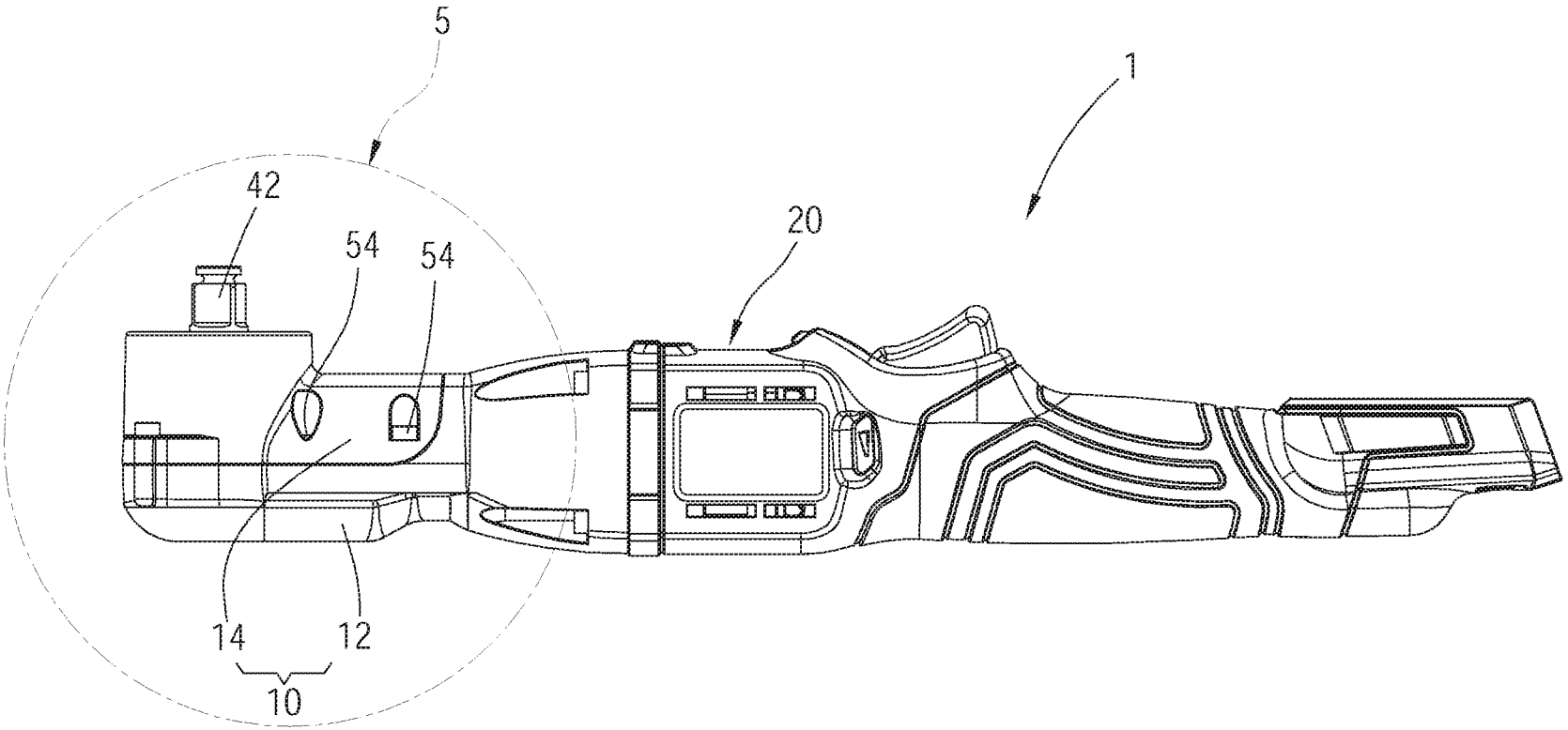
FIG. 2 is a side view of the impact wrench of the first embodiment according to the present invention.
Figure 3:
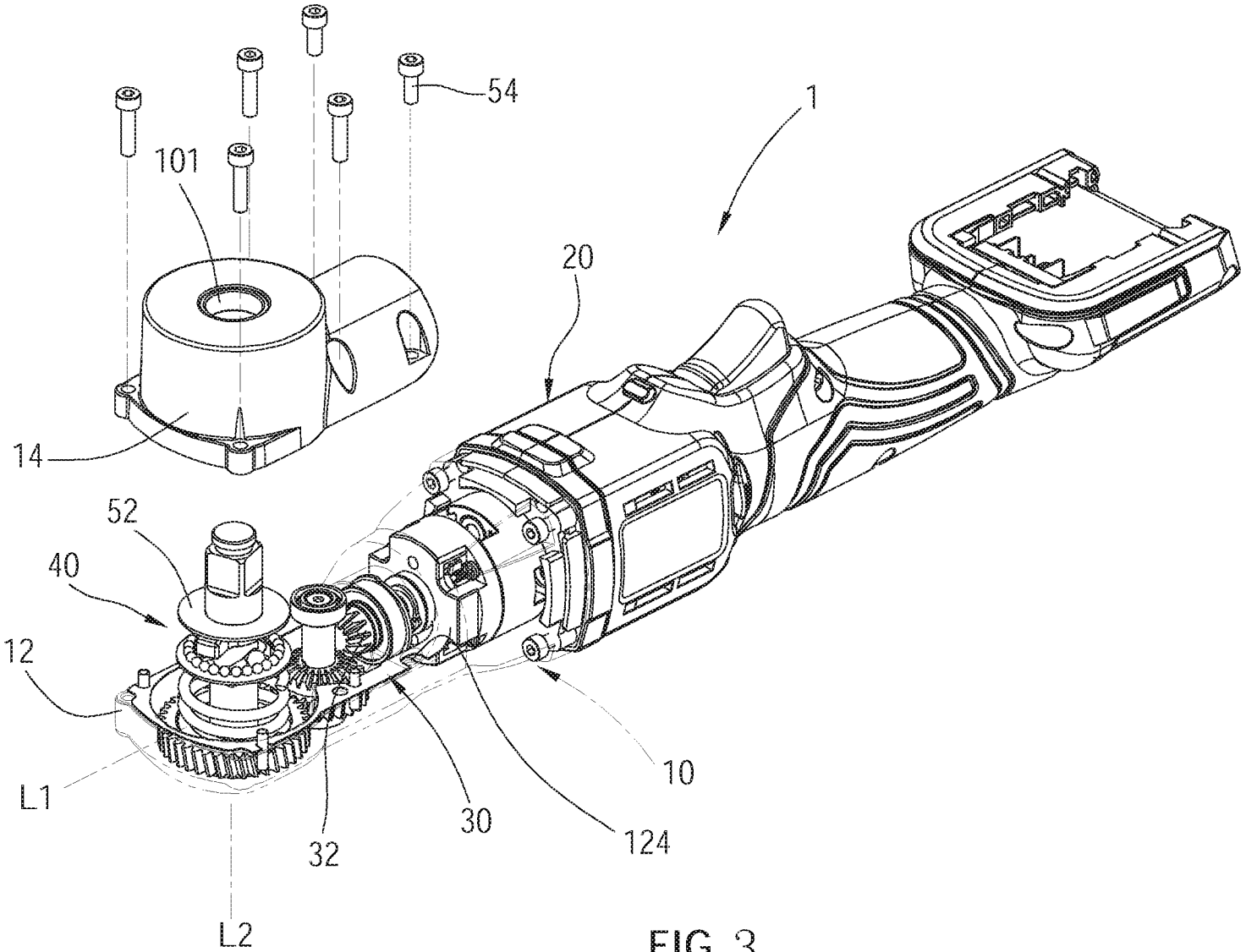
FIG. 3 is a partially exploded view of the impact wrench of the first embodiment according to the present invention.
Figure 4:
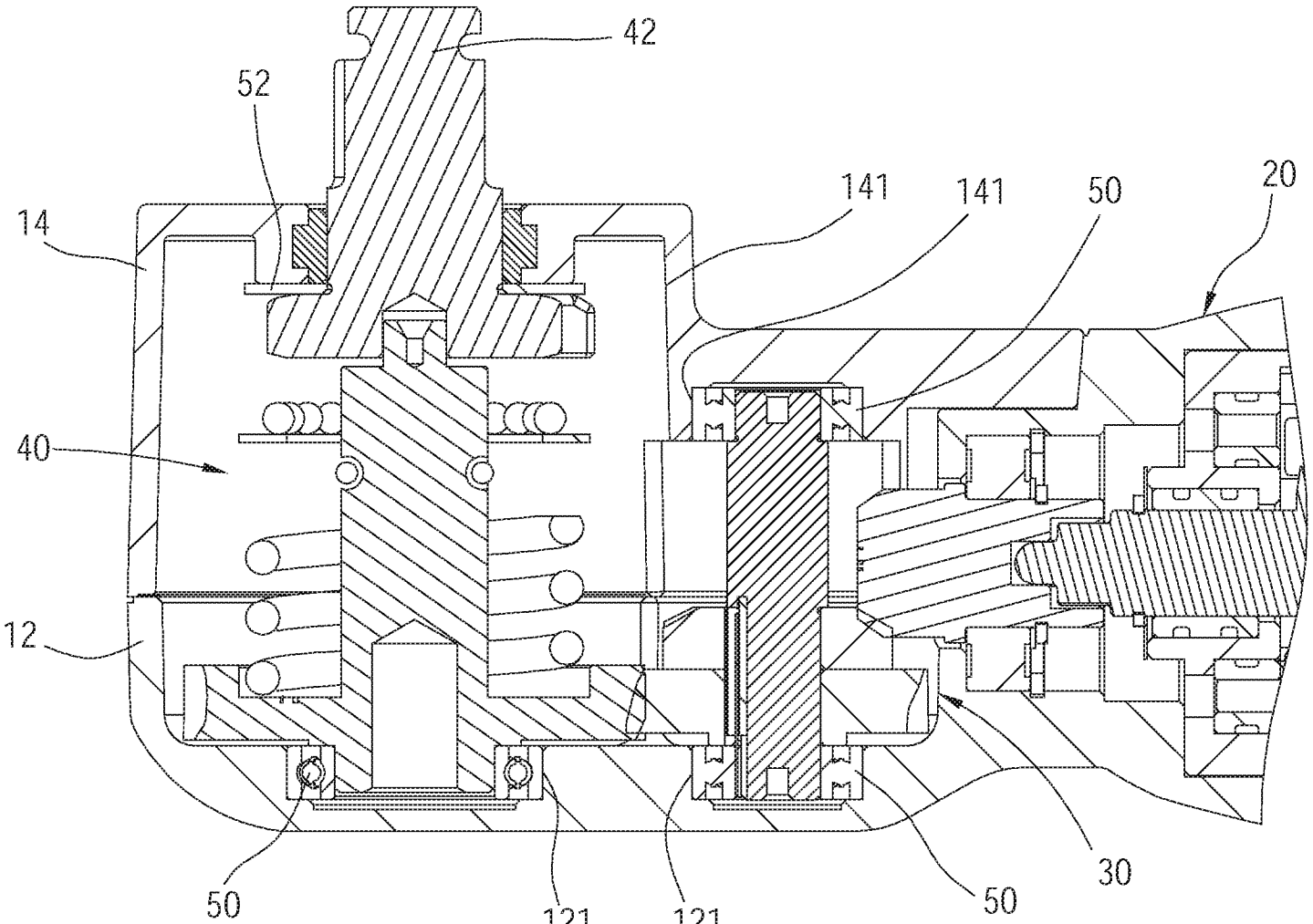
FIG. 4 is a partially sectional view taken along the 4-4 line in FIG. 1.

As illustrated in FIG. 1 to FIG. 5, an impact wrench 1 of a first embodiment according to the present invention includes a front housing 10, a rear housing 20, a transmission mechanism 30, an impact mechanism 40, and a motor (not shown). The transmission mechanism 30 and the impact mechanism 40 are disposed in the front housing 10. The motor is disposed in an internal space of the rear housing 20. In practice, the internal space of the rear housing 20 could be further disposed with a control circuit board, a battery, an electric transducer, a switch assembly, an antenna, a receiver, and so on. Besides, operational interfaces, which include but not limited to a starting switch and a reverse switch, could be disposed on the rear housing 20 in order to activate the impact wrench 1 or to change a rotational direction of the impact wrench 1. The transmission mechanism 30 includes a plurality of gear assemblies, such as a reduction gear assembly, a bevel gear assembly 32, and so on. The plurality of the gear assemblies is driven by an output shaft of the motor to activate the impact mechanism 40. A direction of a force outputted by the motor is changed through the transmission mechanism to drive a working member of the impact mechanism to rotate. The output shaft of the motor rotates around a first axis L1. The impact mechanism 40 includes a working member 42, wherein the working member 42 is in rod-shaped. An end of the working member 42 passes through a perforation 101 of the front housing 10 and is polygonal. The working member 42 rotates around a second axis L2. In the current embodiment, the second axis L2 is perpendicular to the first axis L1. However, in other embodiments, an angle between the first axis L1 and the second axis L2 could be various, but not limited to a right angle. The working member 42 could be connected to a tool, wherein the tool could be a sleeve, a drill bit, or a screwdriver bit.

The front housing 10 includes a seat 12 and a covering member 14, wherein the covering member 14 is detachably engaged with the seat 12 and has the perforation 101, and a part of the working member 42 passes through the perforation 101. The transmission mechanism 30 and the impact mechanism 40 are disposed in the seat 12. When the covering member 14 is disengaged from the seat 12, a part of the transmission mechanism 30 and a part of the impact mechanism 40 are exposed outside, so that carrying out the maintenance (e.g. adding lubricant or cleaning) to the transmission mechanism 30 or the impact mechanism 40 disposed in the front housing 10 becomes more convenient. In the current embodiment, the seat 12 has a first receiving groove 121, and the covering member 14 has a second receiving groove 141. A side of the transmission mechanism 30 and a side of the impact mechanism 40 are received in the first receiving groove 121. Another side of the transmission mechanism 30 and another side of the impact mechanism 40 are received in the second receiving groove 141. The two sides of the transmission mechanism 30 are respectively abutted to the first receiving groove 121 and the second receiving groove 141 via a bearing 50. The side of the impact mechanism 40 is abutted to the first receiving groove 121 via a bearing 50, and the another side of the impact mechanism 40 is abutted to the second receiving groove 141 via a lining plate 52. The covering member 14 and the seat 12 are fastened by a plurality of fixing members 54 (e.g. screw bolts). In this way, the transmission mechanism 30 and the impact mechanism 40 could be securely mounted in a receiving space formed together by the seat 12 and the covering member 14.

Figure 5:
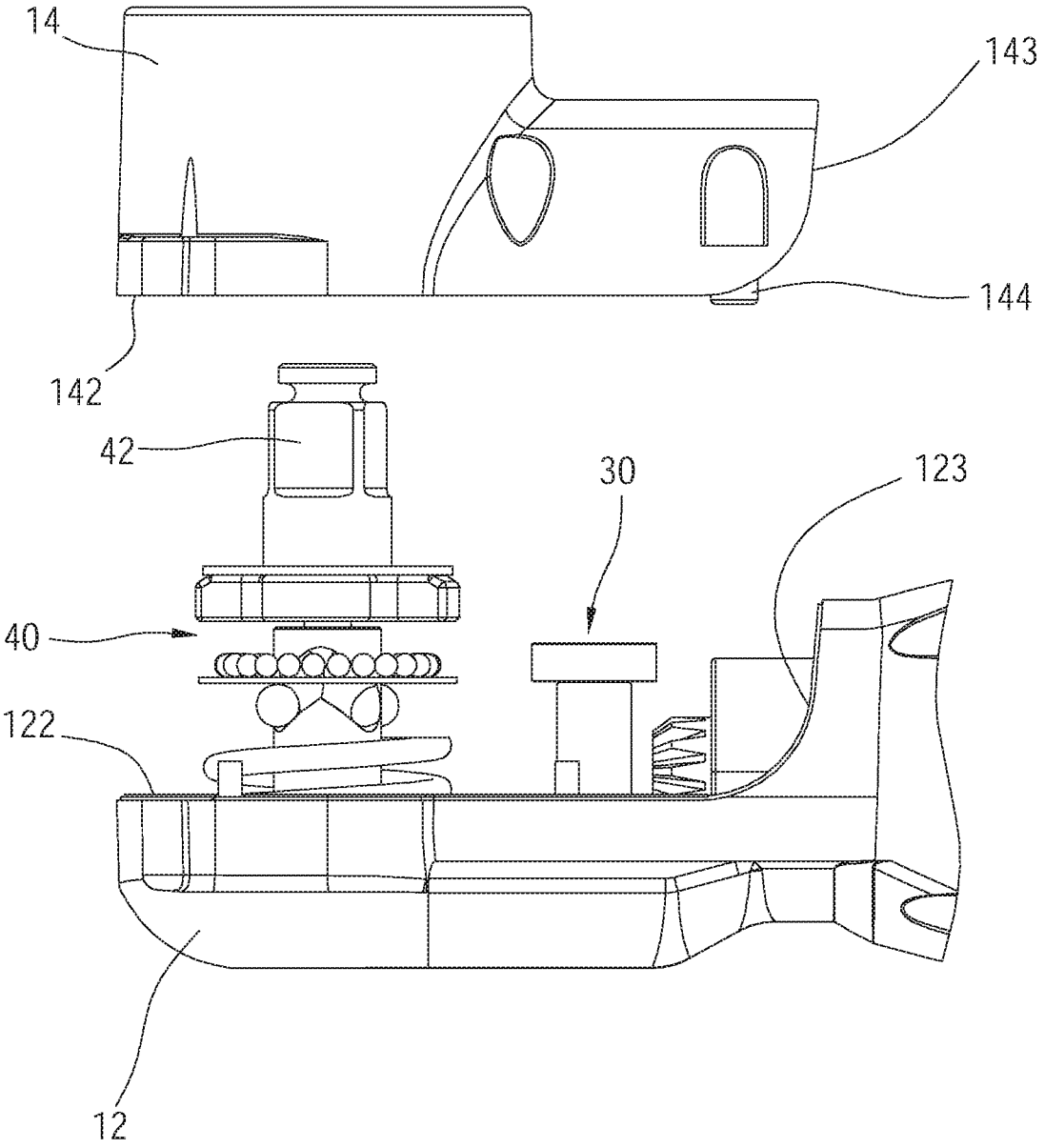
FIG. 5 is an enlarged partial view of a marked region in FIG. 2, showing the covering member is detached from the seat.

The seat 12 has a first joining surface 122 and a first abutting surface 123, which are adjoined, wherein the first joining surface 122 and the first abutting surface 123 are located on different horizontal planes and are not perpendicular to each other. The covering member 14 has a second joining surface 142 and a second abutting surface 143 corresponding to the first joining surface 122 and the first abutting surface 123 respectively. When the seat 12 is engaged with the covering member 14, the second joining surface 142 is closely abutted to the first joining surface 122, and the second abutting surface 143 is closely abutted to the first abutting surface 123. Referring to FIG. 5, in the current embodiment, both the first joining surface 122 and the second joining surface 142 are flat. In practice, if the first abutting surface 123 is a concave surface, the second abutting surface 143 is a convex surface which is complementary to the concave surface of the first abutting surface 123. The covering member 14 includes two protruding members 144, wherein the protruding members 144 are disposed on the second abutting surface 143; the first abutting surface 123 of the seat 12 has two recesses 124 corresponding to the two protruding members 144. In this way, when the second abutting surface 143 is closely abutted to the first abutting surface 123, the protruding members 144 are engaged with the recesses 124, thereby to provide a quick way to align and to position the covering member 14 and the seat 12, enhancing a convenience of assembling the covering member 14 and the seat 12. Moreover, since the first joining surface 122 and the first abutting surface 123 are neither perpendicular to each other nor located on same horizontal planes, and the second joining surface 142 and the second abutting surface 143 are neither perpendicular to each other nor located on same horizontal planes, the first abutting surface 123 and the second abutting surface 143 could be engaged more tightly with a vertical component exerted by the fixing members 54 to the first abutting surface 123 and the second abutting surface 143 when the fixing members 54 are passed through the protruding members 144 and are screwed to the recesses 124 of the seat 12, thereby to improve a seal tightness between the covering member 14 and the seat 12 and to prevent dust coming from outside.

Figure 6:
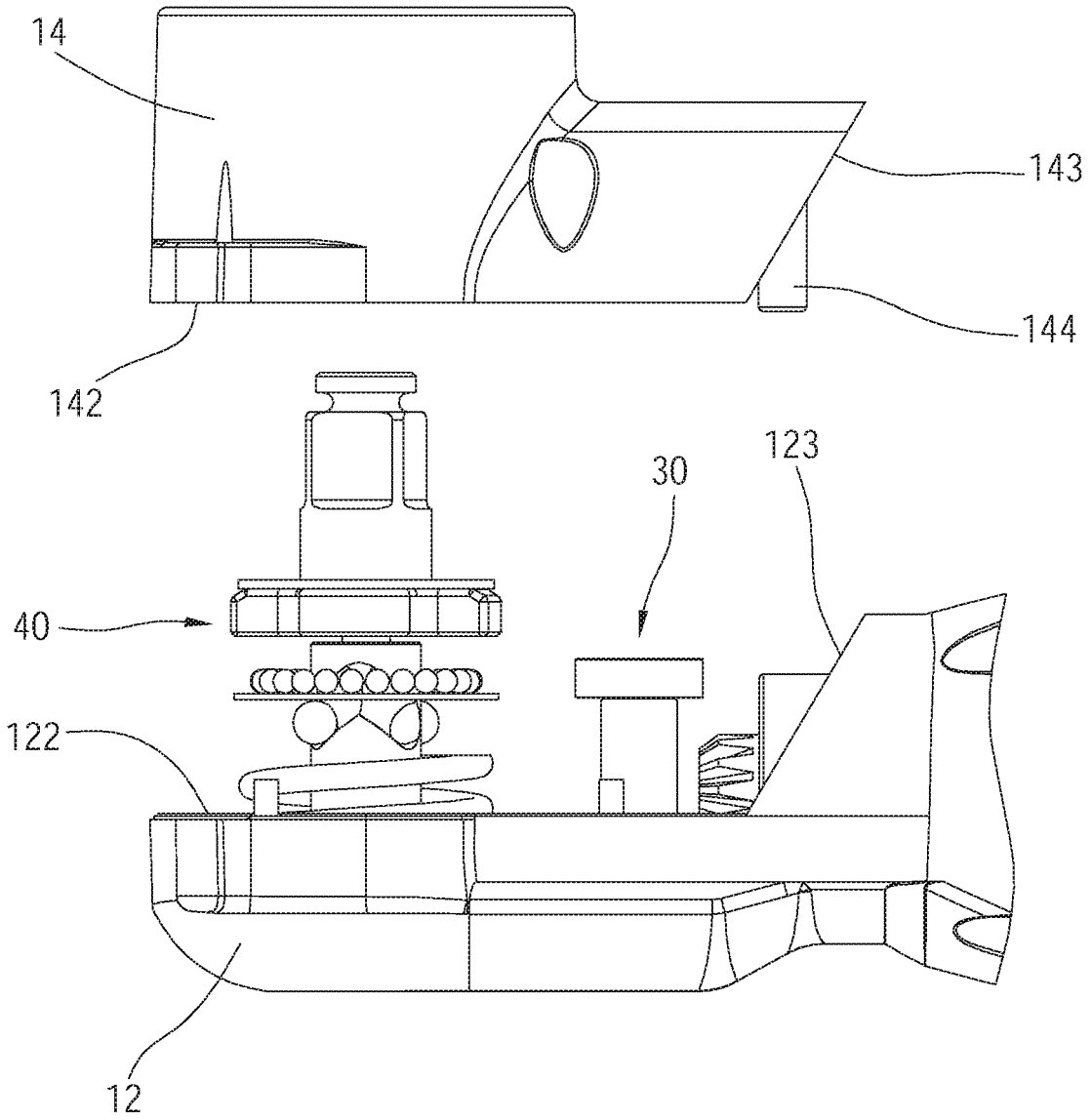
FIG. 6 is similar to FIG. 5, showing the first abutting surface and the second abutting surface of the impact wrench of another embodiment according to the present invention.
Figure 7:
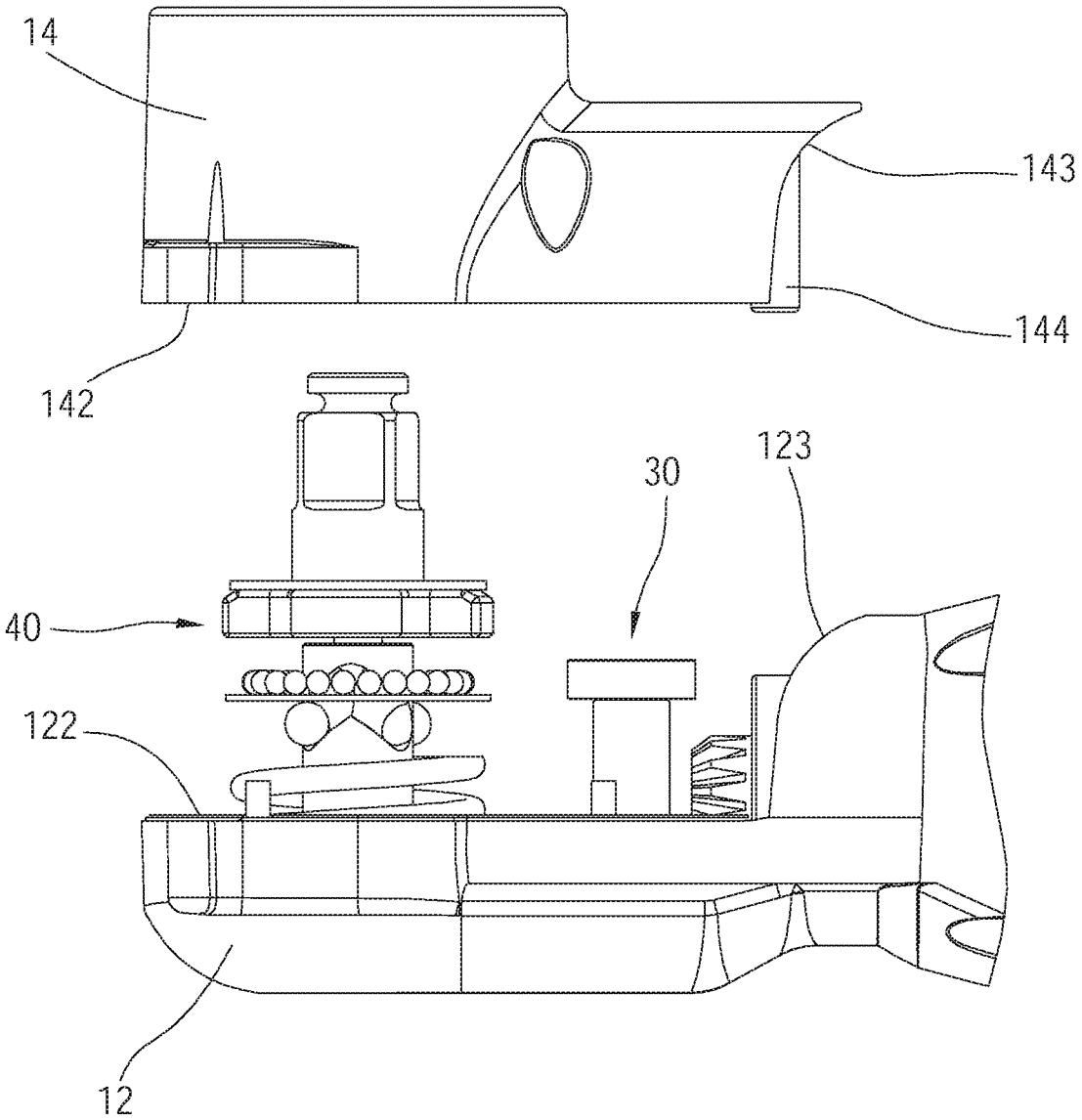
FIG. 7 is similar to FIG. 6, showing the first abutting surface and the second abutting surface of the impact wrench of still another embodiment according to the present invention.

In practice, the first abutting surface 123 and the second abutting surface 143 could also be flat, as shown in FIG. 6. Besides, as shown in FIG. 7, the first abutting surface 123 could be a convex surface, and the second abutting surface 143 could be a concave surface corresponding to the first abutting surface 123, wherein these embodiments shown in FIG. 6 and FIG. 7 could provide the same efficacy as mentioned above.

Figure 8:
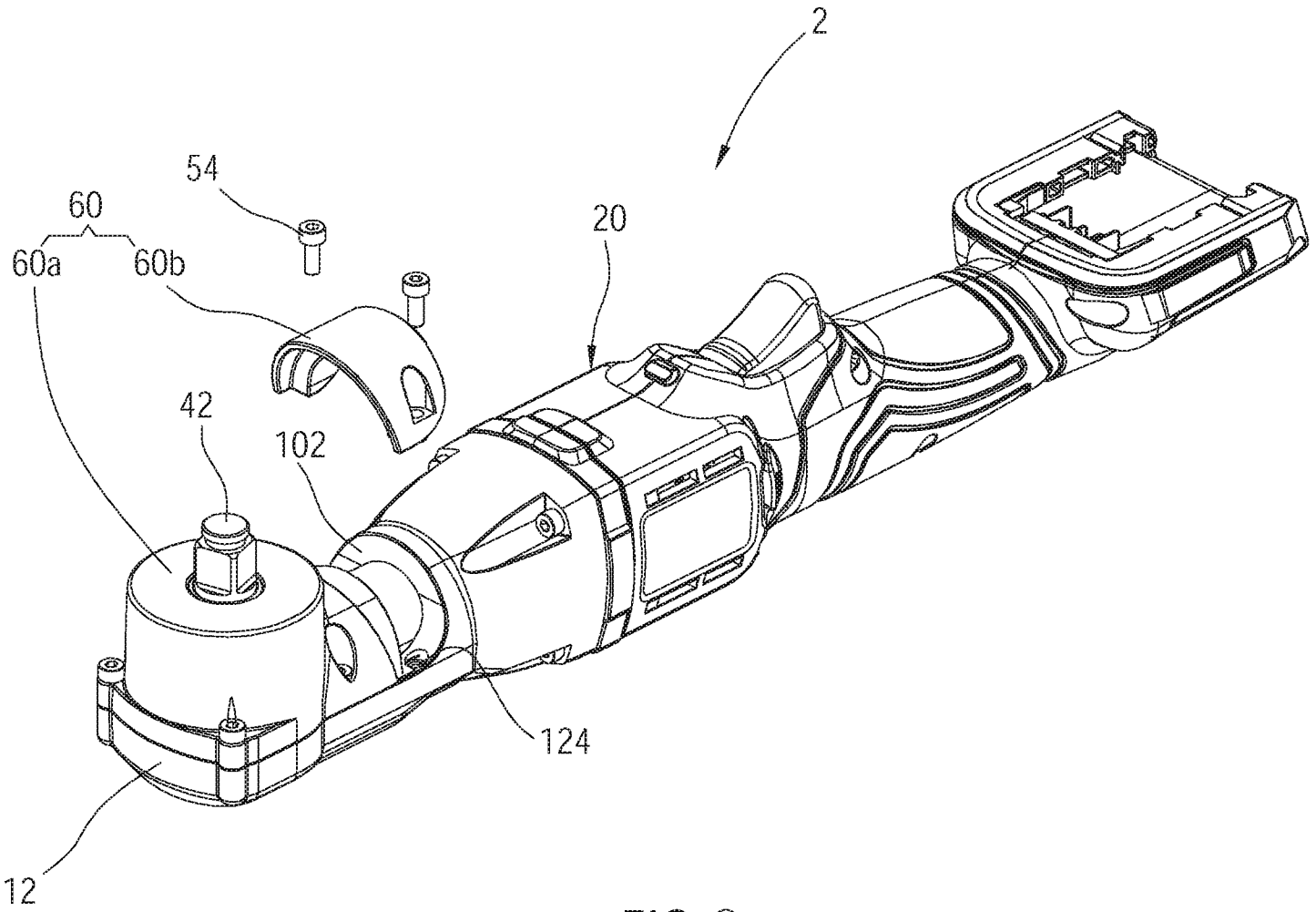
FIG. 8 is a partially exploded view of the impact wrench of a second embodiment according to the present invention.
Figure 9:
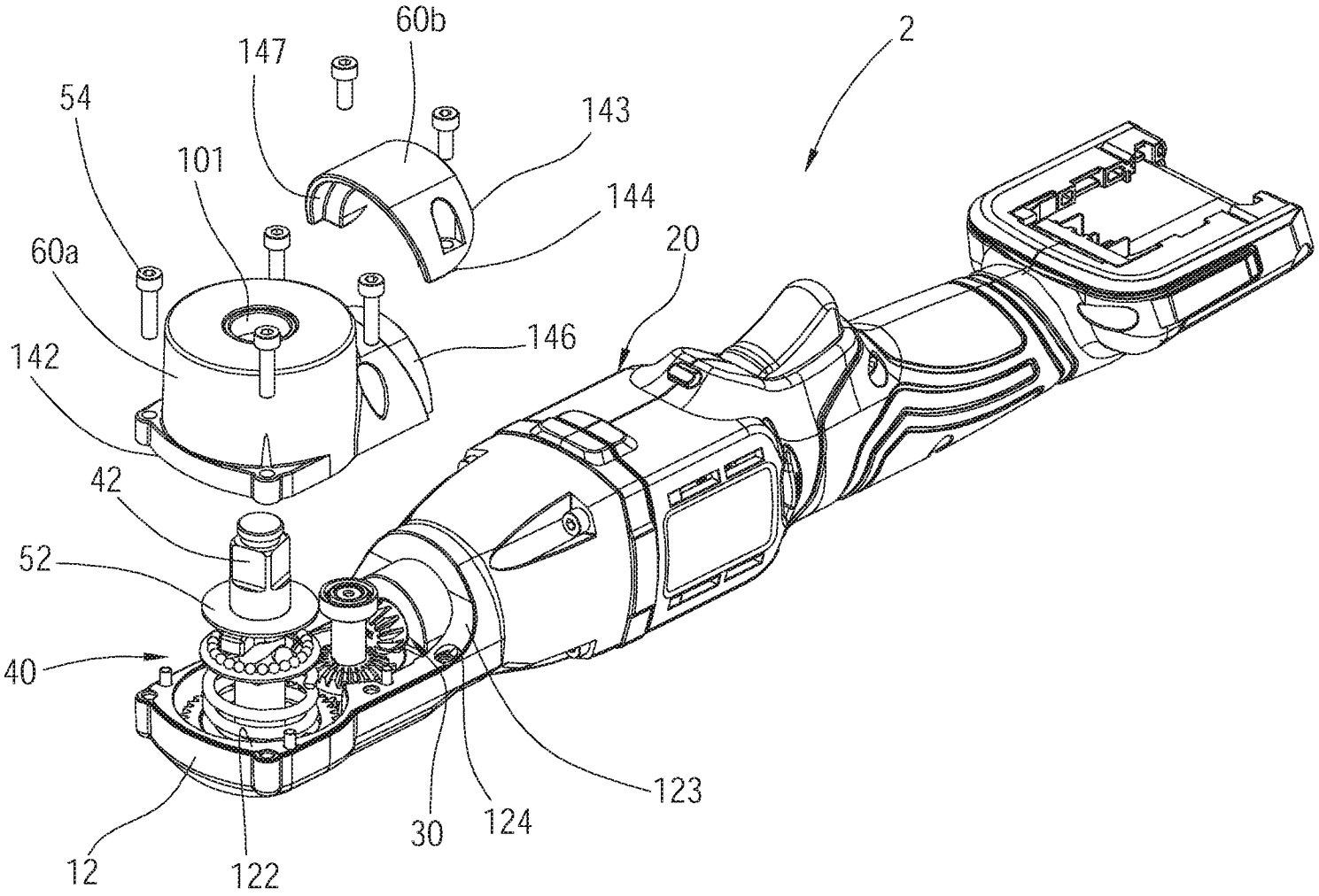
FIG. 9 is a partially exploded view of the impact wrench of the second embodiment according to the present invention.

As illustrated in FIG. 8 and FIG. 9, an impact wrench 2 of a second embodiment according to the present invention has almost the same structure as the first embodiment, except that a covering member 60 is consisted of a first cap 60*a* and a second cap 60*b*, and a receiving space is formed together by the seat 12, the first cap 60*a*, and the second cap 60*b*. When the second cap 60*b* is removed, an opening 102 of the front housing 10, which communicates with the receiving space, is exposed. The first cap 60*a* has the perforation 101, and the part of the working member 42 passes through the perforation 101. The second cap 60*b* is adjacent to the first cap 60*a*, wherein the first cap 60*a* and the second cap 60*b* are located at a same side of the seat 12 and are detachably engaged with the seat 12. In the current embodiment, the first cap 60*a* and the second cap 60*b* are fastened to the seat 12 by the fixing members 54 (e.g. screw bolts).

The seat 12 has the first receiving groove 121, and the first cap 60*a* has the second receiving groove 141, so that the transmission mechanism 30 and the impact mechanism 40 could be securely mounted in the receiving space. As shown in FIG. 9, when the second cap 60*b* is disengaged from the seat 12, the user could maintain an inside of the impact wrench 2 through the opening 102, such as adding lubricant, etc., without breaking an assembled structure of the transmission mechanism 30 and the impact mechanism 40. Therefore, it doesn't need to waste time to reassemble, reposition, and adjust the transmission mechanism 30 and the impact mechanism 40, thereby to improve an efficiency of maintenance. Moreover, depending on the required demand, the user could disengage both of the first cap 60*a* and the second cap 60*b* from the seat 12 at the same time in order to facilitate disassembly, assembly or repair of the transmission mechanism 30 or the impact mechanism 40.

It is worthy to mention that the first cap 60*a* has an extending portion 146 which is adjacent to the opening 102. A side of the second cap 60*b*, which faces the receiving space, has a slot 147 corresponding to the extending portion 146. When the first cap 60*a* and the second cap 60*b* are engaged with the seat 12, the slot 147 is engaged with the extending portion 146, thereby to prevent dust from coming in the impact wrench 2 through a leakage between the first cap 60*a* and the second cap 60*b*. Preferably, faying surfaces of the slot 147 and the extending portion 146 are curved surfaces.

The configuration between the first joining surface 122, the first abutting surface 123, the second joining surface 142, and the second abutting surface 143 is the same as the first embodiment, thus we are not going to describe in details herein. The differences between the first embodiment and the second embodiment are described below. In the current embodiment, the first cap 60*a* has the second joining surface 142, and the second cap 60*b* has the second abutting surface 143. Besides, the second cap 60*b* has the protruding members 144 which are disposed on the second abutting surface 143. The first abutting surface 123 of the seat 12 has the two recesses 124 corresponding to the protruding members 144, so that when the second abutting surface 143 of the second cap 60*b* is tightly abutted to the first abutting surface 123 of the seat 12, the second cap 60*b* could be quickly aligned and mounted by matching the protruding members 144 with the recesses 124 (matching a protrusion and a recess), thereby to enhance convenience of assembling the second cap 60*b* and the seat 12.

Additionally, in the current embodiment, the first abutting surface 123 of the seat 12 is a concave surface, and the second abutting surface 143 of the second cap 60*b* is a convex surface corresponding to the first abutting surface 123; besides, the first joining surface 122 and the first abutting surface 123 are not located at the same horizontal planes and are not perpendicular to each other, and the second joining surface 142 and the second abutting surface 143 are not located at the same horizontal planes and are not perpendicular to each other. With such design, the first abutting surface 123 and the second abutting surface 143 could be engaged more tightly with a vertical component exerted by the fixing members 54 to the first abutting surface 123 and the second abutting surface 143, thereby to improve a seal tightness between the second cap 60*b* and the seat 12 and to prevent dust coming from outside. In practice, the first abutting surface 123 and the second abutting surface 143 could also be flat as mentioned above, or the first abutting surface 123 is a convex surface and the second abutting surface 143 is a concave surface corresponding to the first abutting surface 123.

It must be pointed out that the embodiment described above is only a preferred embodiment of the present invention. All equivalent structures which employ the concepts disclosed in this specification and the appended claims should fall within the scope of the present invention.

What is claimed is:

1. An impact wrench comprising a front housing and a motor, wherein a transmission mechanism and an impact mechanism are disposed in the front housing; a direction of a force outputted by the motor is changed through the transmission mechanism to drive a working member of the impact mechanism to rotate; a part of the working member is protruded and is exposed outside the front housing;

wherein the front housing comprises a seat, a first cap and a second cap, wherein a receiving space is formed together by the seat, the first cap, and the second cap; the first cap has a perforation, and a part of the working member passes through the perforation; when the second cap is removed, an opening of the front housing, which communicates with the receiving space, is exposed.

2. The impact wrench of claim 1, wherein the second cap is adjacent to the first cap, and the first cap and the second cap are located at a same side of the seat.

3. The impact wrench of claim 1, wherein the first cap has an extending portion which is adjacent to the opening; a side of the second cap, which faces the receiving space, has a slot corresponding to the extending portion; when the first cap and the second cap are engaged with the seat, the slot is engaged with the extending portion.

4. The impact wrench of claim 1, wherein the seat has a first joining surface and a first abutting surface, which are adjoined; the first joining surface and the first abutting surface are located on different horizontal planes but not perpendicular to each other; the first cap has a second joining surface corresponding to the first joining surface, and the second cap has a second abutting surface corresponding to the first abutting surface; the second joining surface is closely abutted to the first joining surface, and the second abutting surface is closely abutted to the first abutting surface.

5. The impact wrench of claim 4, wherein the first abutting surface and the second abutting surface are curved surfaces.

6. The impact wrench of claim 5, wherein the second cap has the two protruding members which are disposed on the second abutting surface; the first abutting surface of the seat has the two recesses corresponding to the two protruding members; when the second abutting surface is closely abutted to the first abutting surface, the two protruding members are engaged with the two recesses.

7. The impact wrench of claim 5, wherein the seat has a first receiving groove, the first cap has a second receiving groove; a side of the transmission mechanism is received in the first receiving groove, and another side of the transmission mechanism is received in the second receiving groove; a side of the impact mechanism is received in the first receiving groove, and another side of the impact mechanism is received in the second receiving groove.

8. The impact wrench of claim 4, wherein the first abutting surface and the second abutting surface are flat.

9. The impact wrench of claim 8, wherein the second cap has the two protruding members which are disposed on the second abutting surface; the first abutting surface of the seat has the two recesses corresponding to the two protruding members; when the second abutting surface is closely abutted to the first abutting surface, the two protruding members are engaged with the two recesses.

10. The impact wrench of claim 8, wherein the seat has a first receiving groove, the first cap has a second receiving groove; a side of the transmission mechanism is received in the first receiving groove, and another side of the transmission mechanism is received in the second receiving groove;

a side of the impact mechanism is received in the first receiving groove, and another side of the impact mechanism is received in the second receiving groove.

11. The impact wrench of claim 4, wherein the second cap has the two protruding members which are disposed on the second abutting surface; the first abutting surface of the seat has the two recesses corresponding to the two protruding members; when the second abutting surface is closely abutted to the first abutting surface, the two protruding members are engaged with the two recesses.

12. The impact wrench of claim 4, wherein the seat has a first receiving groove, the first cap has a second receiving groove; a side of the transmission mechanism is received in the first receiving groove, and another side of the transmission mechanism is received in the second receiving groove; a side of the impact mechanism is received in the first receiving groove, and another side of the impact mechanism is received in the second receiving groove.

* * * * *